United States Patent [19]

Howe, Jr.

[11] 4,159,777

[45] Jul. 3, 1979

[54] UNIVERSAL FABRICATED BACKSTOP/BUFFSTOP

[75] Inventor: Thomas W. Howe, Jr., Clarkston, Ga.

[73] Assignee: Halliburton Company, Duncan, Okla.

[21] Appl. No.: 848,860

[22] Filed: Nov. 7, 1977

[51] Int. Cl.[2] ..... B61G 7/10; B61G 9/20

[52] U.S. Cl. ..... 213/10; 213/51

[58] Field of Search ..... 213/7–11, 213/40 R, 40 S, 50, 51, 58, 59, 220–223

[56] References Cited

U.S. PATENT DOCUMENTS

| | | | |
|---|---|---|---|
| 1,074,243 | 9/1913 | Campbell | 213/10 |
| 3,752,329 | 8/1973 | Seay | 213/8 |
| 3,854,596 | 12/1974 | Stephenson | 213/8 |

FOREIGN PATENT DOCUMENTS

| | | | |
|---|---|---|---|
| 1438193 | 4/1966 | France | 213/8 |

*Primary Examiner*—Trygve M. Blix
*Assistant Examiner*—D. W. Keen
*Attorney, Agent, or Firm*—John H. Tregoning; James R. Duzan

[57] ABSTRACT

A universal fabricated backstop/buffstop comprising a pair of parallel, juxtaposed side plates, each side plate having a channel therein, a forward transverse member having the ends thereof secured to the pair of side plates and having a slot located in the center of the forward transverse member, and a rear transverse member having the ends thereof secured to the pair of side plates.

10 Claims, 6 Drawing Figures

UNIVERSAL FABRICATED BACKSTOP/BUFFSTOP

This invention relates generally to railway car structures and more particularly to a universal fabricated backstop/buffstop for end-of-car hydraulic or oleopneumatic cushioning units capable of being installed and removed at the end of a railway car center sill.

Hydraulic or oleopneumatic cushioning units are normally installed in the ends of a railway car center sill structure with the socket end of the cushioning unit anchored to the center sill structure by means of a backstop. Depending upon the type of hydraulic or oleopneumatic cushioning unit, the backstop may also serve as a buffstop for the cushioning unit during full buff (hydraulic compression) of the cushioning unit to transfer the loads from the cushioning unit into the center sill structure. A typical combination backstop/buffstop not only must be designed to transfer loads to the center sill during the buff (hydraulic compression) mode of operation of the cushioning unit with a maximum buff loading being transferred to the center sill when the cushioning unit is abutting the backstop/buffstop, but must also be designed to transfer loads to the center sill during the draft (hydraulic extension) mode of operation of the cushioning unit.

A typical prior art backstop/buffstop has usually either been a casting or a welded fabrication designed for use with a specific railway car center sill structure. Since railway car center sill structures may have the backstop/buffstop either welded to the center sill or merely keyed in position in the center sill, a prior art backstop/buffstop has only been designed for use either as a welded in unit or a keyed in position unit rather than designed for use with both types of sill structures.

In contrast to the prior art, the present invention comprises a universal fabricated backstop/buffstop which can either be welded in position in the railway car center sill or may be keyed in position in the railway car center sill without substantially modifying the backstop/buffstop and which is capable of carrying the required design draft and buff loads of the cushioning units while transferring these loads to the center sill of the railway car.

Figure 1:
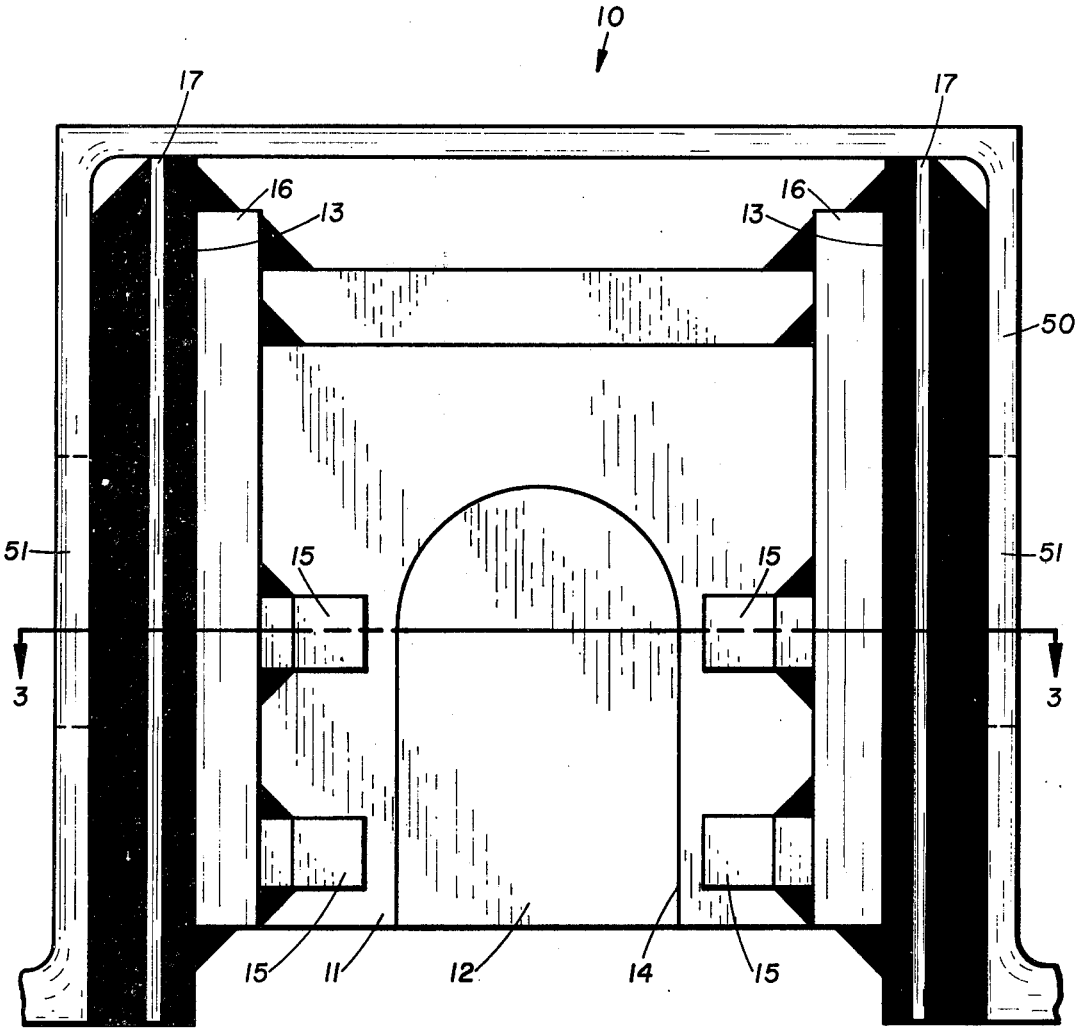
FIG. 1 is a front elevational view of the preferred embodiment of the invention.

Referring to FIG. 1, the universal fabricated backstop/buffstop 10 is shown in its preferred embodiment installed in the center sill 50 of a railway car.

The universal fabricated backstop/buffstop 10 comprises side plates 13 having a forward transverse member 11 and a rear transverse member 12 secured therebetween.

The forward transverse member 11 is shown having a U-shaped opening 14 formed therein through which the end of the rod from a cushioning unit is installed, and reinforcing lugs 15 secured thereto. The reinforcing lugs 15 may be secured to the forward transverse member 11 by any suitable means such as welding. In this connection, if the forward transverse member 11 is made sufficiently thick no reinforcing members may be required. It should be noted that although the forward transverse member 11 has been shown with the reinforcing members 15 welded thereto when made from steel plate, the forward transverse member 11 may either be a forging or a casting with any desired member of reinforcing members integrally formed thereon.

As further shown in FIG. 1, each side plate 13 comprises a plate 16 and a pair of spacer members 17 which space the plate 16 from the center sill 50. The spacer members 17 are secured to each plate 16 by any suitable means such as welding. Similarly, the spacer members 17 can be secured to the center sill 50 by any suitable means such as welding along the bottom edge thereof, a vertical edge thereof and through aperatures 51 in the center sill 50.

Figure 2:
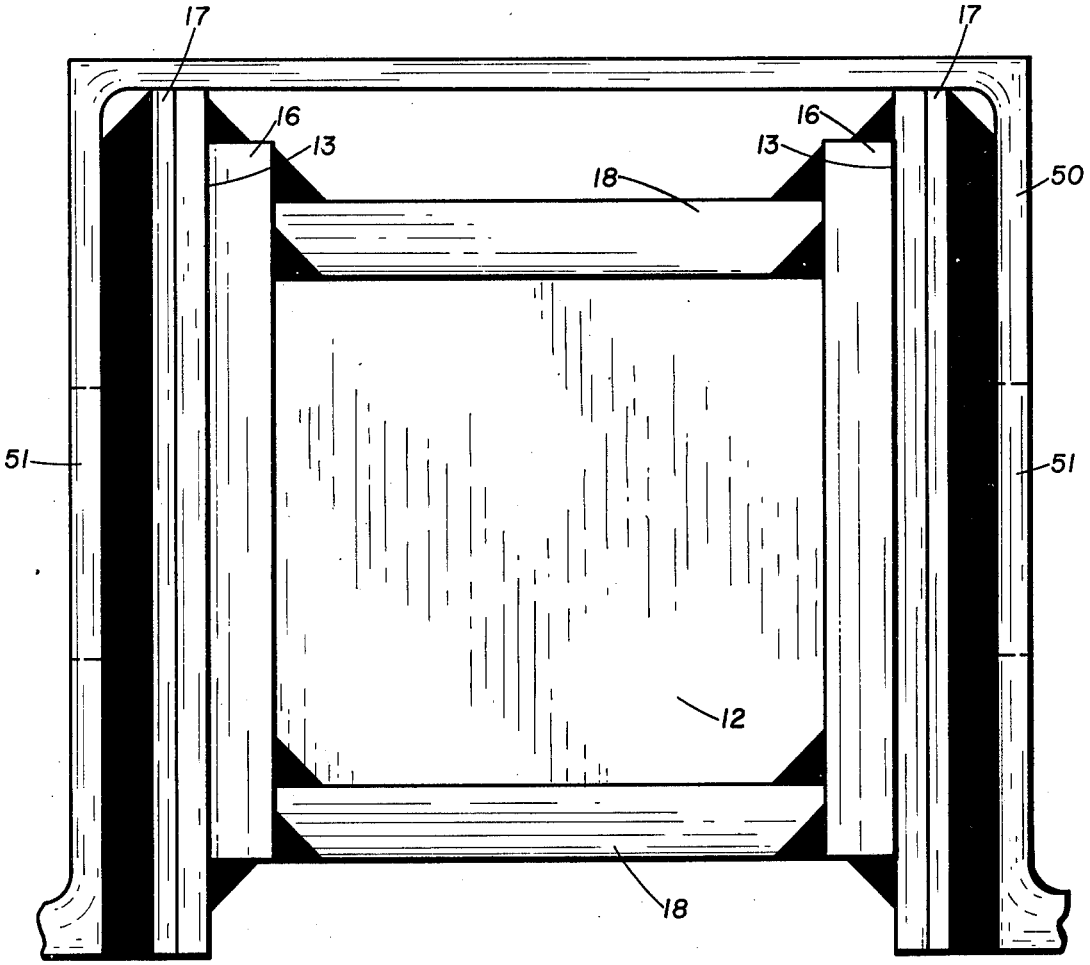
FIG. 2 is a rear elevational view of the preferred embodiment of the invention.

Referring to FIG. 2, the rear transverse member 12 of the universal fabricated backstop/buffstop 10 is shown. The rear transverse member 12 is formed having a plurality of reinforcing ribs 18 secured thereto by any suitable means such as welding. Similarly, the rear transverse member 12 is secured to plates 16 of side plates 13 by any suitable means such as welding. Although two reinforcing ribs 18 have been shown secured to the rear transverse member 12, any number may be employed. For instance, if the rear transverse member 12 is sufficiently thick, no reinforcing ribs may be required while three or more reinforcing ribs may be required as the rear transverse member 12 is made thinner. Even though the rear transverse member 12 has been shown with the reinforcing ribs 18 welded thereto when made from steel plate, the rear transverse member 12 may be either a forging or a casting with any desired number of reinforcing ribs 18 integrally formed thereon.

As further shown in FIG. 2, the spacer members 17 can be secured to the center sill 50 by any suitable means such as welding along the bottom edge thereof, a vertical edge thereof and through aperatures 51 in the center sill 50.

Figure 3:
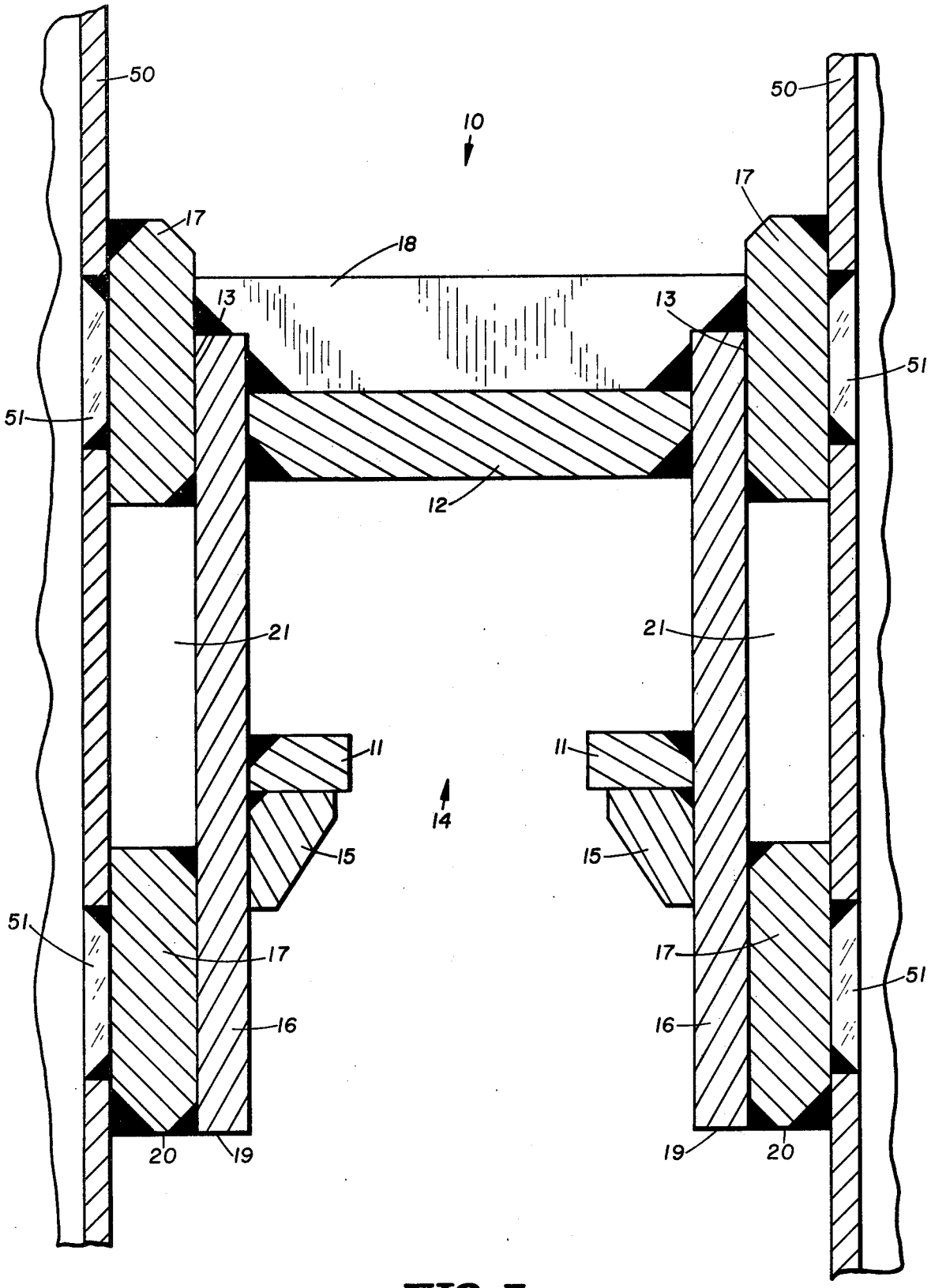
FIG. 3 is a cross-sectional view taken along line 3—3 of FIG. 1.

Referring to FIG. 3, the universal fabricated backstop/buffstop 10 is shown in cross section installed in a center sill 50. Although the side plates 13 have been shown as being comprised of plates 16 welded to spacers 17, having channels 21 therebetween, the side plates 13 may be either a forging or a casting having the spacers 17 integrally formed on plates 16.

As installed in the center sill 50, the universal fabricated backstop/buffstop 10 is welded to the center sill 50 to secure it in position in the center sill 50 via aperatures 51, a vertical edge of each spacer 17 and a bottom edge of each spacer 17 (not shown).

When installed in the center sill 50, the front edges 19 of the plates 16 and the front edges 20 of the spacers 17 serve as the buffstop for the installed cushioning unit.

Figure 4:
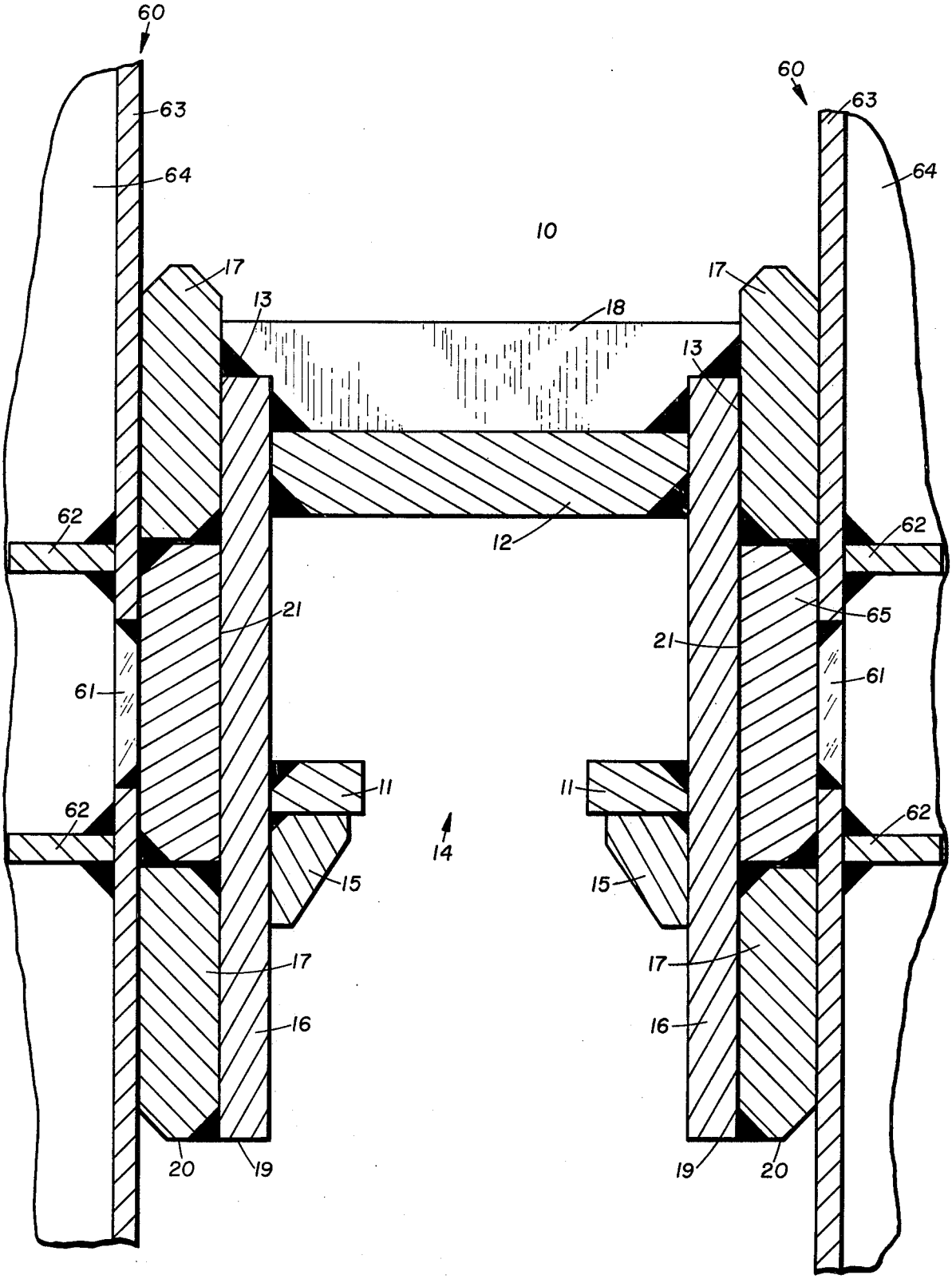
FIG. 4 is a cross-sectional view of the invention installed in a railway car having a modified center sill structure having guide members thereon.

Referring to FIG. 4, the universal fabricated backstop/buffstop is shown installed in a modified center sill 60 of a railway car. The modified center sill 60 comprises a center sill wall having a vertical portion 63 and a flange portion 64, center sill wall strengthening ribs 62 and a backstop/buffstop guide members 65. The backstop/buffstop guide members 65 are secured to the vertical portions 63 of the center sill by any suitable means such as welding. As shown, the backstop/buffstop guide members 65 are welded to the vertical portions 63 of the center sill wall about the guide members' 65 vertical edges, bottom edges (not shown) and through aperatures 61 in the vertical portions 63 of the center sill wall. Similarly, the center sill wall strengthening ribs 62 are secured to the center sill by any suitable means such as welding.

To install the universal fabricated backstop/buffstop 10 in the center sill 60 of a railway car, the universal fabricated backstop/buffstop 10 is inserted into the center sill 60 through the bottom thereof with the backstop/buffstop guide members 65 protruding into the channels 21 formed between the spacer members 17 of each side plate 13. When installed in the center sill 60, the universal fabricated backstop/buffstop 10 is held in position by means of a cover plate (not shown) which covers the bottom of the center sill 60.

During operation, all loads are transferred from the universal fabricated backstop/buffstop 10 to the center sill 60 by the spacers 17 abutting the backstop/buffstop guide members 65 secured to the center sill wall.

When used with a modified center sill 60, since the universal backstop/buffstop 10 is not secured to the center sill 60, it is easily replaceable upon removal of the center sill cover plate and the cushioning unit. In this connection, the modified center sill 60 is easily fabricated since the backstop/buffstop guide members 65 are conveniently secured to the vertical portions 63 of the center sill wall by welding the vertical edges of the guide members, the bottom edges (not shown) of the guide members and through aperatures 61 in the vertical portions 63 of the center sill wall. Any strengthening of the center sill wall portions 63 or 64 by means of strengthening ribs 62 can be easily fabricated since the strengthening ribs are readily accessible from the exterior of the center sill 60.

Figure 5:
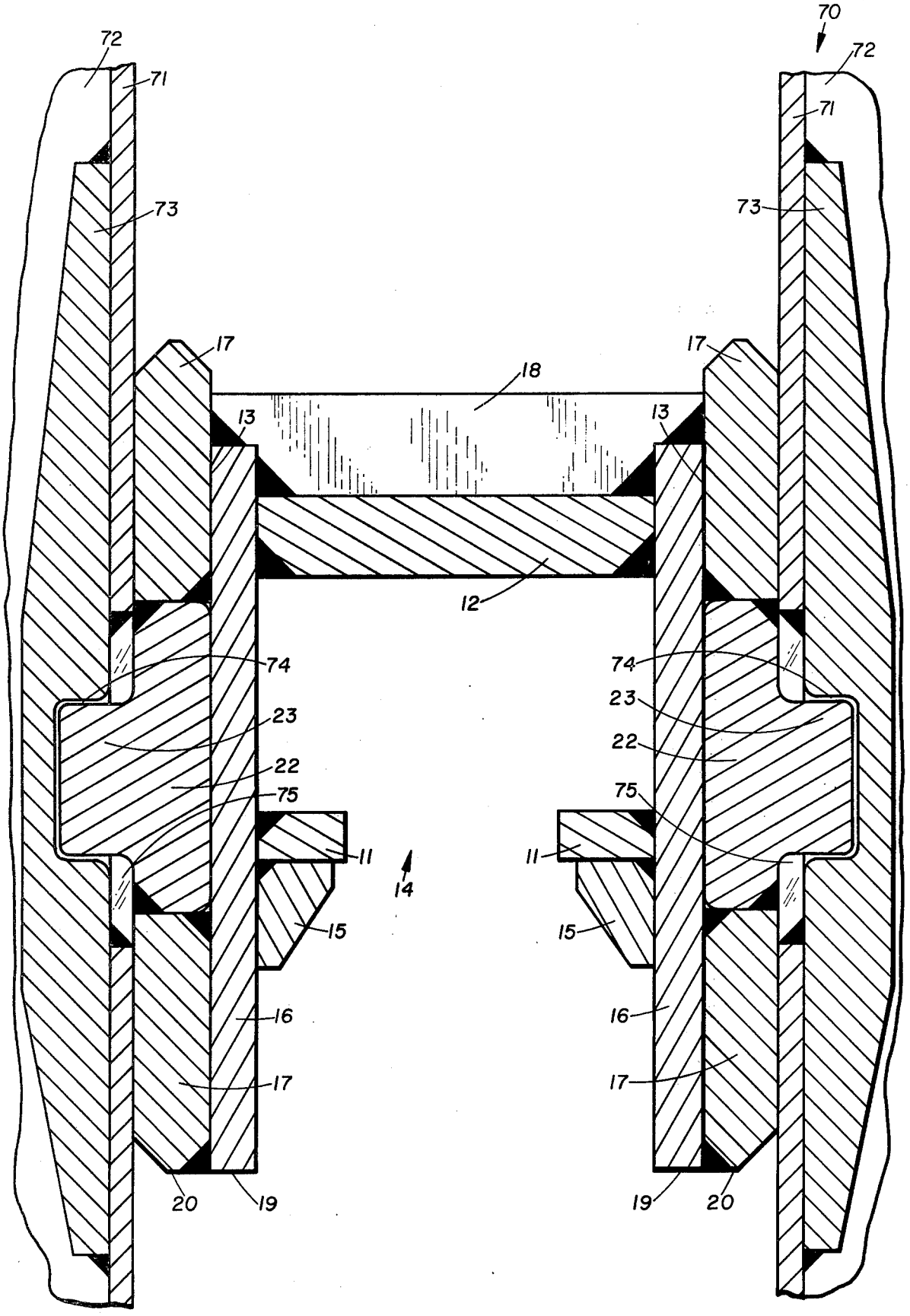
FIG. 5 is a cross-sectional view of the invention installed in a railway car having a modified center sill structure having keyways therein.

Referring to FIG. 5, the universal fabricated backstop/buffstop 10 is shown installed in a standard type center sill 70 of a railway car. The center sill 70 comprises a center sill wall having a vertical portion 71 and a flange portion 72, and center sill wall strengthening plates 73.

Each center strengthening plate 73 is formed with a channel 74 to receive a portion of the universal fabricated backstop/buffstop 10 while the vertical portions 71 of the center sill walls are formed with aperatures 75 to allow passage of a portion of the universal fabricated backstop/buffstop 10 therethrough. The center sill wall strengthening plates 73 may be secured to the center sill 70 by any convenient means, although welding is preferred.

As shown, the universal fabricated backstop/buffstop 10 is formed having a pair of key members 22 secured thereto. A key member 22 is secured to the universal fabricated backstop/buffstop 10 between the spacers 17 in the channel 21 of each side plate 13. The key members 22 may be secured to the universal fabricated backstop/buffstop 10 by any suitable means such as welding. When installed on the universal fabricated backstop/buffstop 10, each key member 22 has an ear (a protruding portion) 23 which mates with the channel 74 in the center sill strengthening plate 73.

To install the universal fabricated backstop/buffstop 10 having a pair of key members 22 located thereon in the center sill 70 of a railway car, the universal fabricated backstop/buffstop 10 is inserted into the center sill 70 through the bottom thereof with the ears 23 of the key members 22 protruding into the channels 74 in the center sill strengthening plates 73. When installed in the center sill 70, the universal fabricated backstop/buffstop 10 is held in position by means of a cover plate (not shown) which covers the bottom of the center sill 70.

During operation, all loads are transferred from the universal fabricated backstop/buffstop 10 to the center sill 60 by the ears 23 on the key members 22 abutting the side walls of the channels 74 in the center sill strengthening plates 73.

When used with the center sill 70, since the universal fabricated backstop/buffstop 10 having key members 22 thereon is not secured to the center sill 70, it is easily replaceable upon removal of the center sill cover plate and the cushioning unit.

Figure 6:
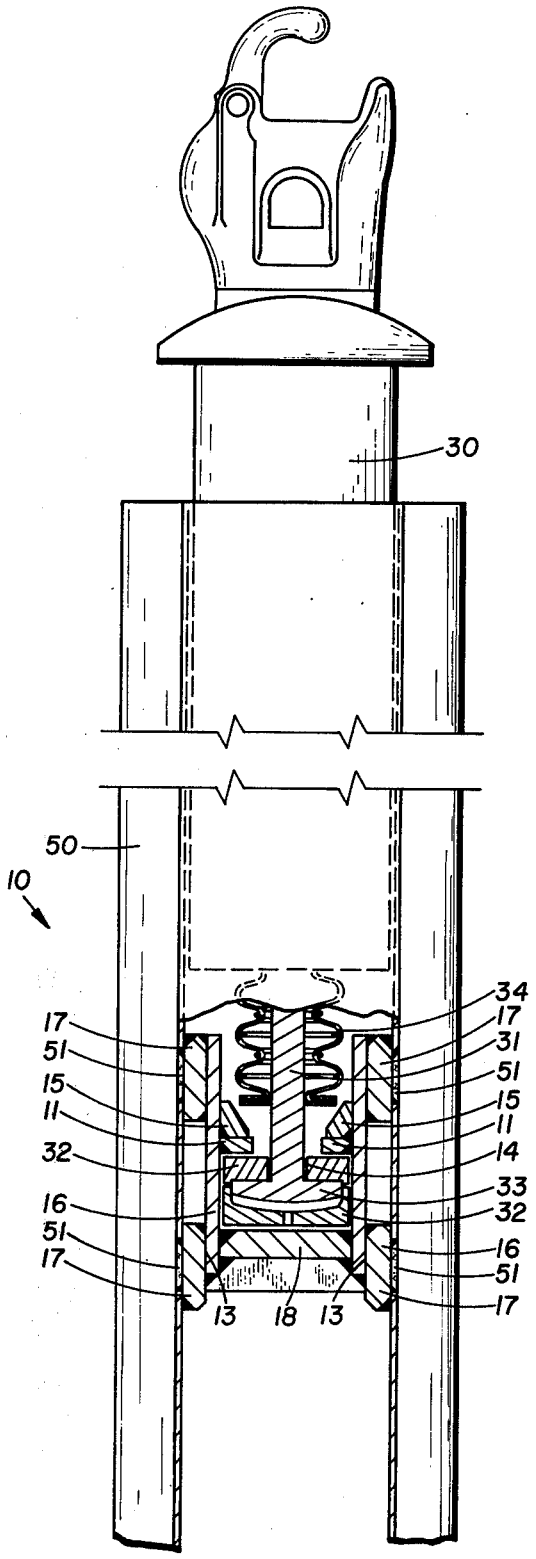
FIG. 6 is a cross-sectional view of the preferred embodiment of the invention installed in the center sill of a railway car having a hydraulic cushioning device installed therein.

Referring to FIG. 6, the universal fabricated backstop/buffstop 10 is shown installed in a center sill 50 of a railway car having a cushioning unit 30 installed therein. A hydraulic or oleopneumatic cushioning unit 30 is installed in the center sill 50 of a railway car having the rod 31 of the cushioning unit 30 projecting through the slot 14 in the forward transverse member 11 of the universal fabricated backstop/buffstop 10 with the socket end 33 of the rod 31 having radius plates 32 thereon being positioned between the forward transverse member 11 and the rear transverse member 12 of the universal fabricated backstop/buffstop 10. A reinforced elastomeric boot 34 may be installed about the rod 31 to serve as a dust cover for the rod 31, if so desired.

When the universal fabricated backstop/buffstop 10 is installed in the center sill 50 of a railway car, it is held in position in the center sill 50 by welding about the peripheral edges of the side plates 13. Although not shown, a cover plate is secured to the bottom of the center sill 50 to cover the cushioning unit 30 and the universal fabricated backstop/buffstop 10. As shown, since there is little clearance between the radius plates 32 on the rod end 33 of the cushioning unit 30 and the plates 16 of the side plates 13, the rod end 33 of the cushioning unit 30 is not free to rotate when installed in the universal fabricated backstop/buffstop 10.

While the universal fabricated backstop/buffstop 10 has been shown in FIG. 6 with a cushioning unit 30 having the socket end of the cushioning unit rod 31 having radius plates 32 thereon installed in the universal fabricated backstop/buffstop 10, the universal fabricated backstop/buffstop 10 can be used with any type cushioning unit, such as a unit having no radius plates on the socket end of the cushioning unit rod, a unit which has the housing end secured in the universal fabricated backstop/buffstop 10 rather than the socket end of the cushioning unit or a unit having a tubular member rather than a solid rod as the cushioning rod. Similarly, although the universal fabricated backstop/buffstop 10 has been shown as welded in the center sill 50, it can be used in center sill designs as illustrated in FIG. 4 and FIG. 5.

While the invention has been described with reference to preferred and modified embodiments, it will be appreciated by those skilled in the art that additions, deletions, modifications and substitutions, or other changes not specifically described may be made which fall within the purview of the appended claims.

What is claimed as new and desired to be secured by Letters Patent is:

1. A universal backstop/buffstop adapted for use in the center sill of a railcar having uniform side wall surfaces therein, adapted for use in the center sill of a railcar having guide means on each side wall surface thereof, and adapted for use in the center sill of a railcar having a channel in each side wall thereof, said universal backstop/buffstop comprising:

a pair of parallel, juxtaposed side plates, each side plate having a channel therein adapted to receive said guide means on the side wall surfaces of said center sill and adapted to receive key means which mates with said channel in each side wall of said center sill;

a forward transverse member having the ends thereof secured to said pair of parallel, juxtaposed side plates, and having a slot located in the center of said forward transverse member; and a rear transverse member having the ends thereof secured to said pair of parallel, juxtaposed side plates whereby said universal backstop/buffstop is adapted to be received within the center sill of a railcar having uniform side wall surfaces therein with said pair of parallel, juxtaposed side plates secured to the uniform sidewall surfaces, said universal backstop/buffstop is adapted to be received within the center sill of a railcar having guide means on each side wall surface thereof with the channel in said side plate slidably engaging said guide means, or said universal backstop/buffstop is adapted to be received within the center sill of a railcar having a channel in each side wall thereof with key means engaging the channel in said side plate and slidably engaging the channel in each side wall of said center sill.

2. The universal backstop/buffstop of claim 1 wherein said rear transverse member further comprises reinforcing means on the rear surface thereof.

3. The universal backstop/buffstop of claim 1 wherein each side plate of said pair of parallel, juxtaposed side plates further comprises key means secured in each channel, said key means having a portion protruding from each side plate adapted to slidably engage the channel in each side wall of said center sill.

4. A universal backstop/buffstop adapted for use in the center sill of a railcar having uniform side wall surfaces therein, adapted for use in the center sill of a railcar having guide means on each side wall surface thereof, and adapted for use in the center sill of a railcar having a channel in each sidewall thereof, said universal backstop/buffstop comprising:

a pair of parallel, juxtaposed side plates, each side plate having a channel therein;

a forward transverse member having the ends thereof secured to said pair of parallel, juxtaposed side plates, and having a slot located in the center of said forward transverse member; and a rear transverse member having the ends thereof secured to said pair of parallel, juxtaposed side plates, and having reinforcing means on the rear surface thereof whereby said universal backstop/buffstop is adapted to be received within the center sill of a railcar having uniform side wall surfaces therein with said pair of parallel, juxtaposed side plates secured to the uniform side wall surfaces, said universal backstop/buffstop is adapted to be received within the center sill of a railcar having guide means on each side wall surface thereof with the channel in said side plate slidably engaging said guide means, or said universal backstop/buffstop is adapted to be received within the center sill of a railcar having a channel in each sidewall thereof with key means engaging the channel in said side plate and slidably engaging the channel in each side wall of said center sill.

5. A universal backstop/buffstop adapted for use in the center sill of a railcar having a channel in each side wall thereof, said universal backstop/buffstop comprising:

a pair of parallel, juxtaposed side plates, each side plate having a channel therein and key means secured in each channel, said key means having a portion protruding from each side plate;

a forward transverse member having the ends thereof secured to said pair of parallel, juxtaposed side plates, and having a slot located in the center of said forward transverse member; and a rear transverse member having the ends thereof secured to said pair of parallel, juxtaposed side plates whereby said universal backstop/buffstop is adapted to be received within the center sill of a railcar having a channel in each side wall thereof with the portion of said key means protruding from each side plate slidably engaging the channel in each side wall of said center sill.

6. A universal backstop/buffstop adapted for use in the center sill of a railcar having a channel in each side wall thereof, said universal backstop/buffstop comprising:

a pair of parallel, juxtaposed side plates, each side plate having a channel therein and key means secured in each channel, said key means having a portion protruding from each side plate;

a forward transverse member having the ends thereof secured to said pair of parallel, juxtaposed side plates, and having a slot located in the center of said forward transverse member; and a rear transverse member having the ends thereof secured to said pair of parallel, juxtaposed side plates, and having reinforcing means on the rear surface thereof whereby said universal backstop/buffstop is adapted to be received within the center sill of a railcar having a channel in each side wall thereof with the portion of said key means protruding from each side plate slidably engaging the channel in each side wall of said center sill.

7. In combination, a center sill of a railway car, said center sill having a guide means located therein, and a universal backstop/buffstop comprising:

a pair of parallel side plates, each side plate slidable in said center sill in juxtaposed relationship and having a channel therein receiving a portion of said guide means located in said center sill;

a forward transverse member having the ends thereof secured to said pair of parallel side plates, and having a slot located in the center of said forward transverse member; and a rear transverse member having the ends thereof secured to said pair of parallel side plates.

8. The combination of claim 7 wherein said rear transverse member further comprises reinforcing means on the rear surface thereof.

9. In combination, a center sill of a railway car, said center sill having a channel in each side wall portion thereof, and a universal backstop/buffstop comprising:

a pair of parallel, juxtaposed side plates, each side plate having a channel therein with key means secured therein having a portion protruding from each side plate, the portion of said key means protruding from each side plate slidably mating with said channel in the wall portion of said center sill;

a forward transverse member having the ends thereof secured to said pair of parallel side plates, and having a slot located in the center of said forward transverse member; and a rear transverse member having the ends thereof secured to said pair of parallel, juxtaposed side plates.

10. The combination of claim 8 wherein said rear transverse member further comprises reinforcing means on the rear surface thereof.

* * * * *